United States Patent [19]

Rayburn et al.

[11] 4,044,214

[45] Aug. 23, 1977

[54] ILLUMINATED TWO-COLOR SELECTOR SWITCH

[75] Inventors: Donald Lee Rayburn, Asheville, N.C.; Larry Ray Sunday, Brown Deer; Edgar Robert Larsen, Milwaukee, both of Wis.

[73] Assignee: Square D Company, Park Ridge, Ill.

[21] Appl. No.: 669,548

[22] Filed: Mar. 23, 1976

[51] Int. Cl.[2] ..... H01H 9/00

[52] U.S. Cl. ..... 200/316; 200/311

[58] Field of Search ..... 200/311–314, 200/316, 317, 310, 308

[56] References Cited

U.S. PATENT DOCUMENTS 2,693,165 11/1954 Appleman ..... 200/316

2,713,103 7/1955 Slate ..... 200/316

2,918,555 12/1959 Lindberg ..... 200/311

*Primary Examiner*—Herman J. Hohauser

*Attorney, Agent, or Firm*—Michael J. Femal; William H. Schmeling

[57] ABSTRACT

The selector switch has two operating positions, indicated by different colors of light. An operator knob having two spaced translucent portions of different colors is drivingly connected to a tubular switch operator rotor. A lamp shield is received within the rotor around a lamp. The lamp shield has an aperture which directs light only through the translucent portion of the selector switch knob directly over the aperture so that the color of the visible light corresponds to a particular operating position of the selector switch knob.

9 Claims, 13 Drawing Figures

ILLUMINATED TWO-COLOR SELECTOR SWITCH

BACKGROUND OF THE INVENTION

This invention relates to illuminated selector switches and, more particularly, to a selector switch characterized by a rotatable operator knob having two spaced translucent portions and a stationary lamp shield having an aperture for directing light selectively through the colored translucent portions of the knob in correspondence to the operating positions of the knob.

Typically, selector switches are illuminated by a single lamp to distinguish only between ON or OFF positions of the switch. Still others employ more costly construction using two lamps for use with either one or two selector switch operators to indicate by separate color designations more than one operative switch position. Representative prior art of the illuminated ON or OFF position of the selector switch includes U.S. Pat. No. 3,320,393, and representative prior art of the two-color illuminated switch includes U.S. Pat. No. 3,681,552.

However, all of the known selector switches lack the efficient construction of the present invention which utilizes a single selector switch operator and a single lamp to provide a different color light indication for each of two switch positions.

SUMMARY OF THE INVENTION

An object of the present invention is to provide an improved illuminated two-color selector switch.

Another object is to provide illuminated two-color selector switch which utilizes a single selector switch operator and a single lamp to effect different colored indications for each of two switching positions.

A further object is to provide an illuminated two-color selector switch in which an operator knob having two translucent portions of different colors and a lamp shield are, respectively, insertable within the operator rotor of a common line of illuminated selector switches to adopt these switches to provide a different colored light emission for each of two positions.

In accordance with the present invention, an illuminated two-color selector switch includes an operator knob, having two differently colored translucent portions, rotatably mounted on an operator housing and connected to one end of an operator rotor for corotation therewith. A light module mounted on the operator housing includes a lamp and a lamp socket that are positioned within a central passage of the operator rotor. A lamp shield positioned in the operator rotor surrounds the lamp and is keyed to the lamp socket. The lamp shield includes an aperture for directing light through only the translucent portion of the knob directly above the stationary aperture as the selector switch knob is rotated through its various operating positions. This construction permits a reduction in the number of parts required to provide a different light indication for the various switching positions than previous construction.

BRIEF DESCRIPTION OF THE DRAWINGS

Other objects and advantages will become apparent from the following description wherein reference is made to the accompanying drawings illustrating a preferred embodiment of the invention and in which.

DESCRIPTION OF PREFERRED EMBODIMENT

Figure 1:
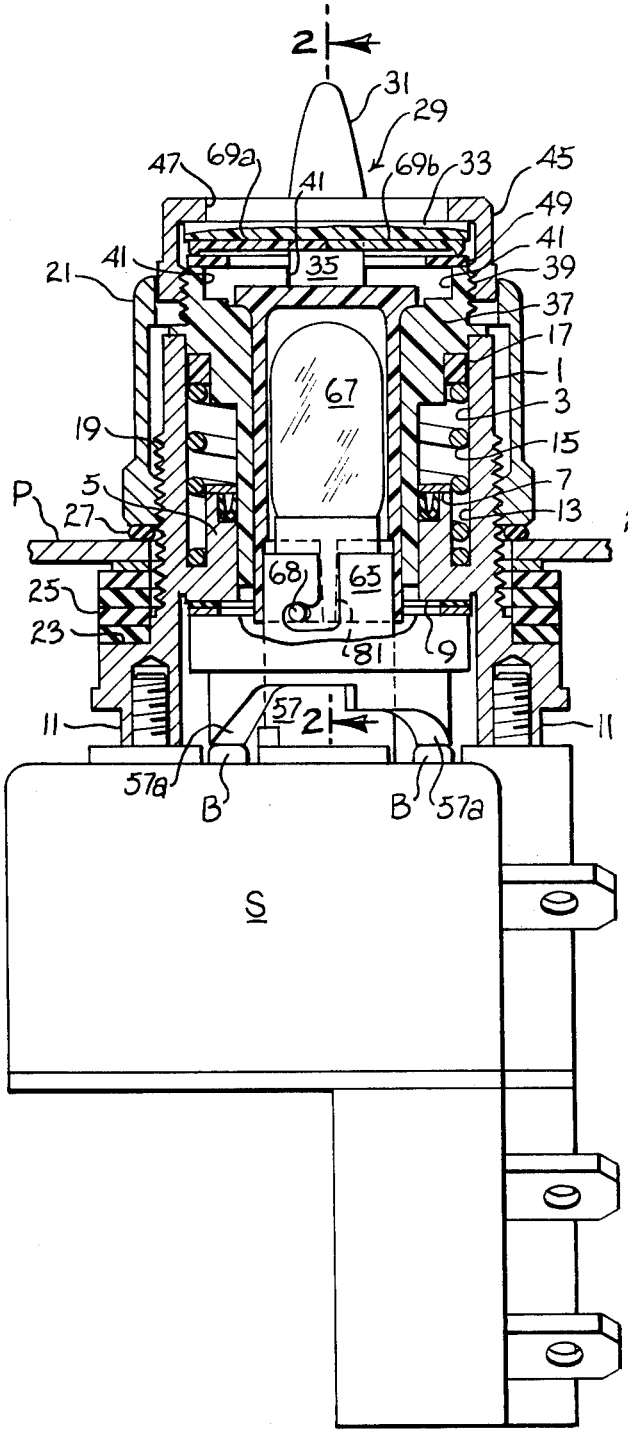
FIG. 1 is a vertical diametrical sectional view of an illuminated two-color selector switch embodying the principles of the present invention.
Figure 2:
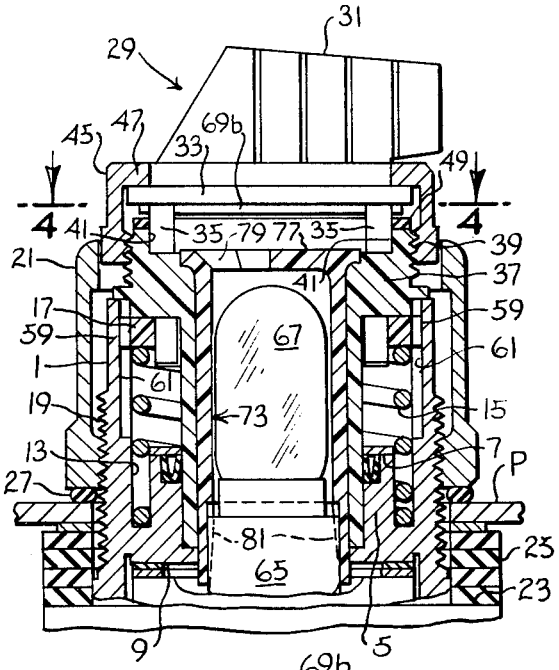
FIG. 2 is a sectional view of the selector switch operator taken on the line 2—2 in FIG. 1.
Figure 3:
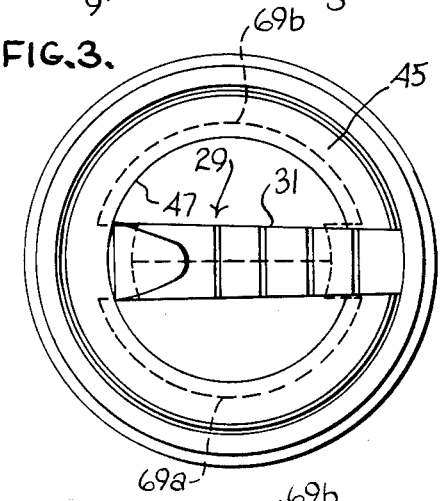
FIG. 3 is a top plan view of an operating knob of the selector switch of FIGS. 1 and 2.
Figure 4:
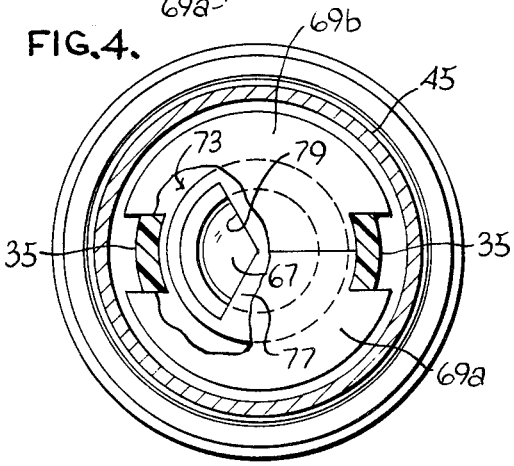
FIG. 4 is a top plan view of the switch as illustrated in FIG. 3, part thereof being shown in section to illustrate the relationship of the color chips and aperture when the lamp is de-energized.

The preferred embodiment of the illuminated two-color selector switch operator in accordance with the present invention is illustrated in FIGS. 1 and 2 and includes a cylindrical metal operator base 1 having an axial passage 3 extending entirely therethrough. The passage 3 is restricted by an internal annular rib 5 which terminates at its ends in spaced relation to the ends of the base 1, respectively, and provides an upwardly facing upper shoulder 7 and a downwardly facing lower shoulder 9. At its lower end, the base 1 is provided with circumferentially spaced bosses 11 which are internally threaded for cooperation with bolts for securing the base 1 to a light module M and switches S as disclosed in a U.S. Pat. No. 3,315,060, granted to R. C. Rothweiler et al on Apr. 18, 1967. As disclosed in the Rothweiler patent, the module M and switches S have spring biased operating plungers or pushbuttons B which, when the base 1 is mounted on the module M in position for operation by the selector switch, are engaged by cams of the selector switch.

The rib 5 is provided with an upwardly-opening annular recess 13 which receives a helical spring 15 that urges a detent indexing ring 17 (to be described later) toward the upper end of the base 1. The base 1 is externally threaded, as indicated at 19, and accommodates a ring nut 21. When the base 1 is received through a complementary opening in a panel P, it can be drawn firmly into clamping relation to the panel by means of the ring nut 21 and an upwardly facing shoulder 23 on the base 1. Suitable electrically insulating and oil sealing gaskets 25 are interposed between a rear face of the panel P and the shoulder 23. A nameplate 27 may be interposed between the ring nut 21 and the forward face of the panel P.

The operator base 1 thus can be readily installed on a panel in operating position. The various operating parts of the switch including the module M and the switches S can be installed in and on the base 1 as a factory subassembly before or after installation of the base 1 on the panel and can readily be removed from the base 1 and replaced.

Among the removable parts of the switches, is a generally circular, two-colored translucent selector switch knob 29 illustrated in FIGS. 1, 2, 3, 6 and 7, and which has a finger gripping portion 31, an outer radial flange 33, and a pair of diametrically opposed depending lugs 35.

Figure 5:
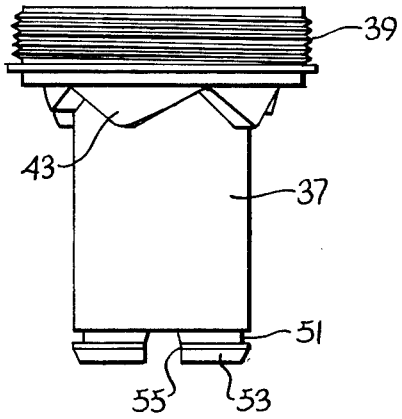
FIG. 5 is a side elevation of a rotor of the switch of FIGS. 1, 2 and 4.
Figure 6:
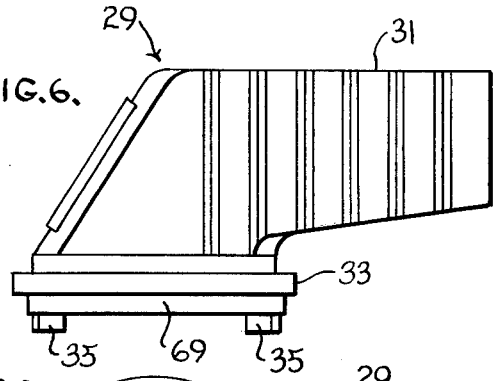
FIG. 6 is a side elevation of the knob of FIG. 3.
Figure 7:
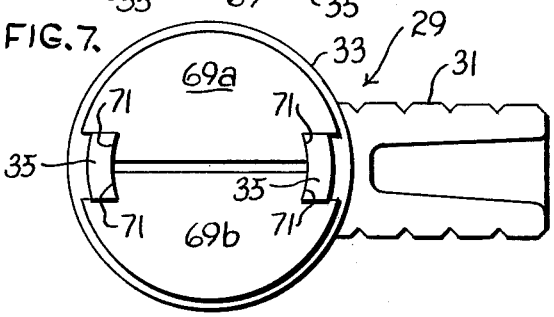
FIG. 7 is a bottom plan view of the selector switch knob of FIGS. 3 and 6.
Figure 8:
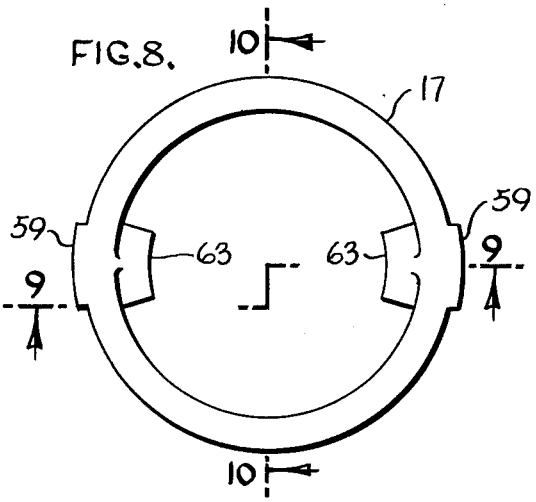
FIG. 8 is a top plan view of an operator rotor detent indexing ring of the switch of FIGS. 1, 2 and 4.
Figure 9:
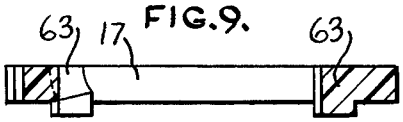
FIG. 9 is a side elevation of the detent indexing ring taken along line 9—9 in FIG. 8.
Figure 10:
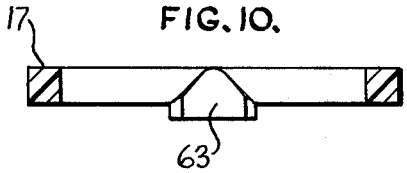
FIG. 10 is a side elevation of the detent indexing ring taken along line 10—10 in FIG. 8.

The knob 29 is removably connected to a rotor 37 which, as illustrated in FIGS. 1, 2 and 5, is generally in the form of a cylindrical sleeve having at its upper end an externally threaded portion 39 of larger external diameter than the remainder of the sleeve. The enlarged upper portion 39 has four upwardly open, circumferentially spaced notches 41 adjacent its inner periphery and arranged at 90° intervals to receive snuggly the depending lugs 35 of the knob 29 for connecting the rotor 37 to the knob 29 for rotation thereby.

As shown in FIG. 5, the enlarged upper portion 39 of the rotor 37 has a depending annular serrated flange 43 which extends endwise of the rotor 37 and is spaced outwardly on the underside of the enlarged portion 39 from the smaller diameter portion adjacent thereto. The serrations of the flange 43 are adapted for connection with the detent indexing ring 17, infra, which is urged into engagement by the spring 15 as will later be described.

For securing the knob 29 in fixed position axially on the upper end of the rotor 37, a ring nut 45 is in threaded engagement with the upper threaded portion 39 of the rotor 37. The ring nut 45 is provided with an inwardly projecting annular shoulder 47 which engages the upper face of the flange 33 of the knob 29 and thereby forces the flange 33 downwardly firmly against a gasket 49 interposed between the upper end of the rotor portion 39 and the bottom surface of the flange 33. The gasket 49 forms an effective seal to prevent the infiltration of oil and moisture into the interior of the switch between the knob and operator rotor. In the engagement just described, the knob 29 and the rotor 37 are secured firmly together for corotation about the axis of the central passage of the base 1.

The rotor 37 is formed from an electrical insulating material which is relatively stiff but sufficiently resilient for snap fastening engagement with a cam carrier (not shown) similar to the one described in U.S. Pat. No. 3,320,393, supra.

A lower end portion of the rotor 37 is provided with an external, circumferential groove 51 and a nose portion 53 extending downwardly from the groove 51 to the lower end of the rotor. The nose portion 53 tapers inwardly for assisting in snap-fastening engagement of the rotor 37 with the cam carrier. Two diametrically opposite notches 55 are provided in the lower end of the rotor 37 and extend from the plane of the upper side of the groove 51 entirely to the lower end face of the rotor, thus dividing the lower end of the rotor 37 into two snap-fastening portions which are adapted for snap-fastening engagement with the cam carrier, as previously mentioned.

Referring to FIG. 1, a cam 57 connected to the cam carrier (not shown) is illustrated. The lower end of the cam 57 has a plurality of operating lobes 57a adapted to engage the operating plungers B of the module M and to move the plungers B and plungers of the switches S, not shown, axially of the rotor 37 and base 1 upon rotation of the cam 57 about the axis of the base 1. The cam 57 is annular, having a central opening extending entirely therethrough coaxial with the central opening of the cam carrier and rotor 37.

Turning now to FIGS. 2, 8, 9 and 10, the detent indexing ring 17 is annular with its central opening coaxial with the central opening of the cam carrier and the rotor 37. The detent indexing ring 17 further includes a pair of diametrically opposed ribs 59 which extend outwardly from the outer surface of the ring 17 to fixedly engage one of three pairs of adjacently spaced diametric notches 61 which extend endwise on the inner periphery of the upper portion of the operator base 1. Opposite each rib 59, on the inner surface of the ring 17, is a pair of knobs 63 proportioned to engage the serrations of the depending annular flanges 43. The central opening of the ring 17 accommodates the smaller diameter portion of the rotor 37 with operating clearance. The spring 15 urges the ring 17 upwardly so that its knobs 63 are received in the serrations of the depending annular flange 43 which are in position corresponding to the lobes of the cam to be associated with the ring 17, so as to yieldably indicate when the cam lobes are in full operating position, respectively. The rotor 37 is limited in its rotation by a limiting ring (not shown) which is attached to the cam carrier and has an upwardly extending projection that is received in a groove on the lower shoulder 9 of the base 1 to limit maximum rotational movement in each direction of the knob and rotor.

The construction and operation of the above described selector switch operator is similar to the operator disclosed in U.S. Pat. No. 3,320,393 supra, except for the indexing means just described.

As previously mentioned, it is desirable in many instances that the selector switch be illuminated in different colors to indicate particular selected switching positions of the switch.

To provide the illumination, the light module M is mounted at the rear end of the operator to position a lamp socket 65 and a removable lamp 67 within the coaxial connecting central passages of the rotor 37 and the cam carrier. The light module M includes the lamp socket 65 with opposing bayonet-type slots having one end connected to the switch S and its other end positioning the socket 65 and the removable lamp 67 in the central passages of the cam carrier and the rotor 37. The lamp 67 is coupled by a bayonet-type connection to the lamp socket 65 and extends upwardly into the interior cavity of the rotor 37. The lamp socket 65 contains suitable connections and leads within the module M for connecting the lamp to a source of power.

Referring now to FIGS. 4, 6, 7, and 11–13, a preferred embodiment of the invention is shown in which a conventional ON-OFF two or three position selector switch operator can be converted to provide a two color function when a different light indication is required for left and right switch positions. For example, it may be desirable to have a red indication for a left switch position, no indication for a center (OFF) position, and a green indication for a right switch position. To accomplish the two color function, a pair of generally identical, semicircular translucent chips **69*a* and 69*b*, one red and the other green, are ultrasonically welded to the bottom surface of the flange 33. The chips form a circle of a lesser diameter than the outer radial flange 33. Lugs 35 intersect the dividing line between the red and green chips 69*a* and 69*b* near their outer periphery and the chips 69*a* and 69*b* have adjacent cutouts 71 complimentary to the lugs 35** so that the lugs 35 extend through the cutouts below the chips to engage notches 41 in the rotor 37.

Figure 11:
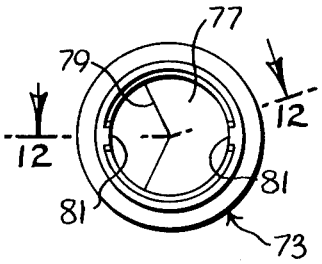
FIG. 11 is a top plan view of a lamp shield of the switch of FIGS. 1, 2 and 4.
Figure 12:
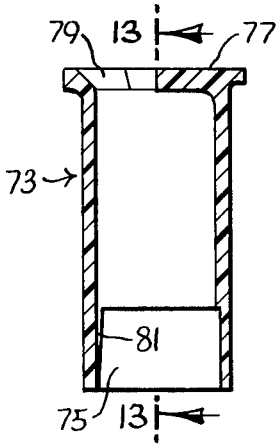
FIG. 12 is a side elevation of the lamp shield taken along the line 12—12 of FIG. 11.
Figure 13:
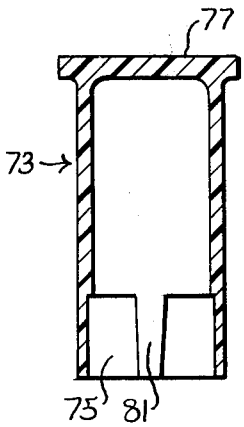
FIG. 13 is a side elevation of the lamp shield taken along line 13—13 of FIG. 12.

FIGS. 11–13 show a lamp shield 73 having a cylindrical configuration with a lower open end 75 and a capped upper end 77. The capped end 77 has an aperture 79. On the inner periphery of the lower end 75 of lamp shield 73, a pair of diametrically opposed ribs 81 extend radially inwardly corresponding approximately in dimensions to the vertical slots of the bayonet socket 65. Lamp shield 73 is inserted into the coaxial opening of the rotor 37 with its open end 75 first disposed within the barrel of the rotor 35 around lamp 67 and is keyed to the lamp socket 65 so as to be indexed in position within the rotor 37 by its ribs 81 being received in the vertical slots of the bayonet socket 65.

In operation, the two-color selector switch knob secured to rotor 37 by ring nut 45 is rotated from its center (OFF) position to its left switching position, lamp 67 is energized and the red chip 69*a* is disposed directly above aperture 79 so that when light from lamp 67 is directed through aperture 79 toward knob 29 essentially only red light is transmitted from the knob. If knob 29 is rotated from the left switching position through the center (OFF) position, lamp 67 is re-energized and the green chip 69*b* is disposed directly above aperture 79 so that essentially only green light is transmitted from the knob. When lamp 67 is de-energized, corresponding to center (OFF) position, aperture 79 is bisected by the line between the two-color chips 69*a* and 69*b*.

If, and when it is desirable to reverse the colors which indicate the left and right switching positions, this is accomplished by first removing the knob 29 and then removing lamp shield 73, rotating it 180°, reinserting it into the barrel of rotor 37, and keying it again to lamp socket 65 as previously described.

Preferably, the size of the annular opening of the aperture 79 is less for a two position switch than a three position switch as the two position rotor rotates approximately a total of 70° when switching from one position to the other and a three position selector switch, when switching from the left switching position through the center position to the right switching position, rotates approximately a total of 140°. Therefore, the three position function requires a larger aperture opening in the lamp shield. In a two position type selector switch, in which an indicating color is desirable in both switching positions, the light module is not de-energized during the transition from one position to the other.

Having thus described our invention, we claim:

1. In an illuminated selector switch operator comprising a base member having an axial passage, a rotor rotatably received in the axial passage and drivingly connected to a switch operating means for operating a switch in relation to at least two rotated positions of the rotor, the rotor having an axial passage coaxial with the axial passage of the base, the passages being open at their common ends, a light source removably mounted in the passage of the rotor, and an operating knob removably connected to one of the open ends of the rotor for effecting rotation of the rotor and the knob to the two rotated positions, the improvement comprising a lamp shield removably mounted and fixedly received in the passage of the rotor around the light source and having an aperture in an otherwise closed end for directing light from the light source toward the knob, and the knob having at least two translucent portions one of which is positioned to be in alignment with the aperture in a first rotated position of the knob and the other of which is positioned to be in alignment with the aperture in a second rotated position of the knob.

2. An illuminated selector switch including an operator base having an axial passage extending therethrough, a switch operating means connected to said base, a rotor mounted in the axial passage for rotation about the axis of the passage and drivingly connected to the switch operating means for operating the switch in relation to at least two rotated positions of the rotor, the rotor having a central passage coaxial with said axial passage and open at both ends, a light module mounted in the central passage, the improvement comprising: a lamp shield detachably mounted around the light module and stationarily received in the central passage of the rotor, said shield having an aperture for directing light from the light module toward one of the open ends of the rotor; and a translucent operating knob detachably connected to the one end of the rotor for rotating the rotor through its operating positions and disposed directly over the stationary aperture, said knob having at least two different colored translucent portions, one of which is positioned to be in alignment with the aperture in a first rotated position of the knob and the other of which is positioned to be in alignment with the aperture in a second rotated position of the knob, so that as the knob and rotor are corotated, the aperture directs light to pass through only the colored portion of the knob corresponding to that selected operating position of the selector switch.

3. An illuminated selector switch according to claim 2, wherein the two different colored translucent portions of the knob comprise a pair of translucent semi-circle plastic chips, each of a different color.

4. An illuminated selector switch according to claim 3, wherein said chips are ultrasonically welded on the bottom side on each half of the knob.

5. An illuminated selector switch according to claim 2, wherein said light module includes a lamp and a socket for receiving said lamp, said lamp and socket having pins and slots, respectively, for bayonet coupling and wherein said lamp shield being cylindrical and having a pair of radially inwardly disposed, diametric ribs at one end removably positioned in the slots of the socket so that by removing and rotating the shield 180° and reinserting it into the central passage of the rotor the shield is indexed relative to the socket, and the colored portions representing a particular operating position of the selector switch are reversed.

6. An illuminated selector switch operator having a base with a through lineal passage therein, a rotor means mounted in the passage for rotation about the axis of the passage, said rotor means having a central passage coaxial with said lineal passage, a translucent operating knob coaxial with, and removably connected to, one end of the rotor means for corotation therewith, and a light source removably mounted within said coaxial central passage for illuminating said knob, the improvement comprising: a pair of translucent chips mounted on the bottom side on each half of the knob adjacent said light source, each of said chips having a different color to indicate a particular selected operating position of the selector switch; and a means for isolating light removably mounted and stationarily received within the coaxial central passage and disposed between said knob and said light source, said light isolating means having an aperture which permits light to pass through only the colored chip directly over the stationary aperture as the operating knob and the rotor means are selectively turned to the selected operating positions of the selector switch thereby sequentially changing the relative position of each chip with respect to said aperture.

7. The illuminated selector switch operator of claim 6 in which said translucent chips are colored red and green to indicate the selected operating positions of the selector switch.

8. The illuminated selector switch operator of claim 7 in which the selector switch operator is a three position switch having operative left and right positions, and an OFF center position, said light source being energized in the operative left and right positions to illuminate the red and green chips respectively, and being de-energized in the center position in which neither chip is illuminated.

9. An illuminated selector switch operator of claim 7 in which the selector switch operator is a two position switch having two operative positions, said light source being energized in both positions to illuminate either the red or green chip corresponding to the particular switch position.

* * * * *